United States Patent [19]

Hair et al.

[11] Patent Number: 5,040,568

[45] Date of Patent: Aug. 20, 1991

[54] DIRECT DRIVE SERVOVALVE HAVING POSITIVE RADIAL LIMIT STOP

[75] Inventors: Kenneth Hair, Valencia; Kenneth Laux, Newhall, both of Calif.

[73] Assignee: HR Textron Inc., Valencia, Calif.

[21] Appl. No.: 551,718

[22] Filed: Jul. 10, 1990

[51] Int. Cl.[5] ..... F15B 13/044

[52] U.S. Cl. ..... 137/625.65; 251/129.12; 251/284; 310/36

[58] Field of Search ..... 137/625.65; 251/129.12, 251/284; 310/36

[56] References Cited

U.S. PATENT DOCUMENTS

| | | | |
|---|---|---|---|
| 4,507,634 | 3/1985 | Vanderlaan | 310/36 |
| 4,641,812 | 2/1987 | Vanderlaan et al. | 310/36 X |
| 4,793,377 | 12/1988 | Haynes et al. | 137/628.65 |

*Primary Examiner*—Gerald A. Michalsky

*Attorney, Agent, or Firm*—Nilsson, Robbins, Dalgarn, Berliner, Carson & Wurst

[57] ABSTRACT

Disclosed is a direct drive servovalve which includes a drive motor mounted upon a housing for a reciprocally disposed spool valve wherein the rotor of the drive motor engages the spool valve. The rotational motion of the rotor is converted into linear motion in the spool-valve. The rotor of the drive motor carries a cam shaped flat washer which has surfaces engaging stop means defined by the valve housing.

6 Claims, 2 Drawing Sheets

FIG. 2
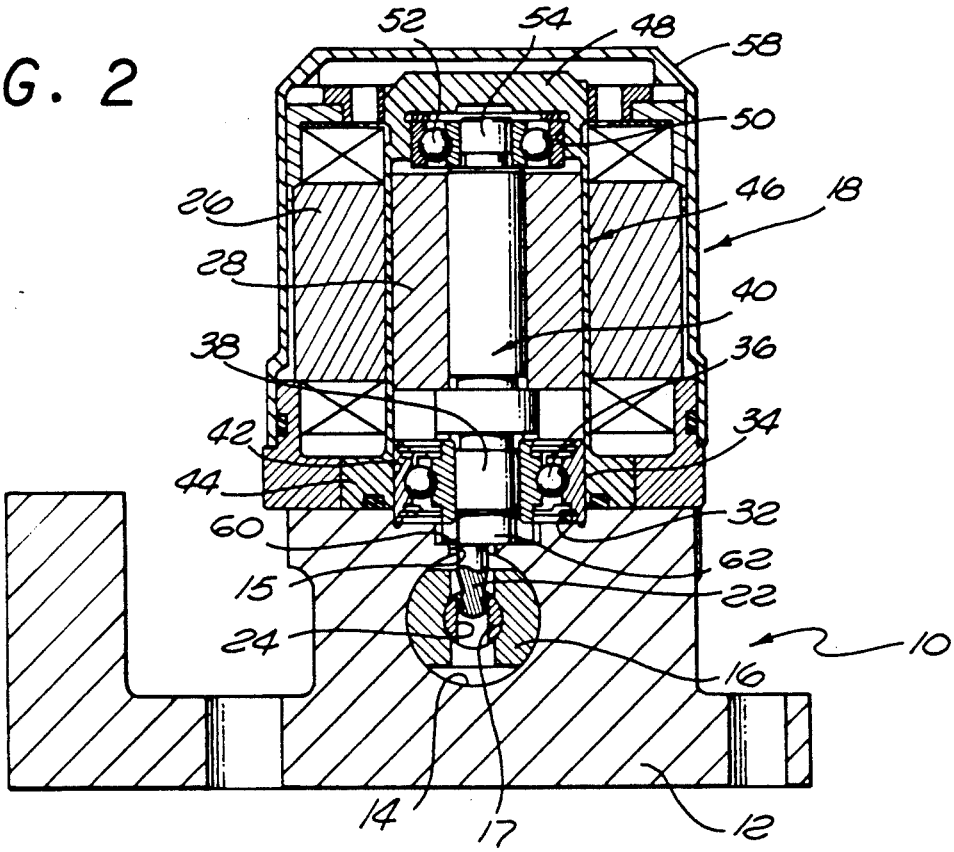
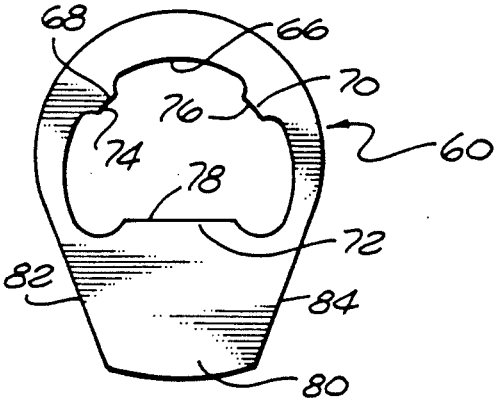
FIG. 3
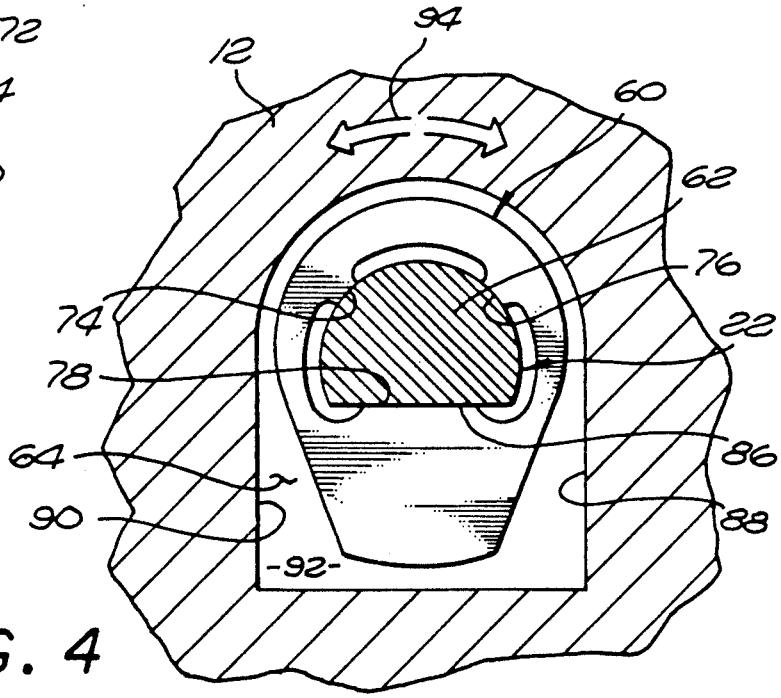
FIG. 4

DIRECT DRIVE SERVOVALVE HAVING POSITIVE RADIAL LIMIT STOP

FIELD OF THE INVENTION

This invention relates to direct drive servovalves and more particularly to a direct drive servovalve in which rotational motion of a motor rotor is converted into linear motion of a spool valve wherein the drive motor includes a positive radial limit stop.

BACKGROUND OF THE INVENTION

Torque motor-driven spool valves are well known in the art including such valves which operate through the utilization of a rotary torque motor having a drive member extending from the rotor thereof into contact with the spool valve to directly reciprocate the spool valve within a bore provided in the valve housing to thereby control the flow of fluid from a source thereof to the load in response to electrical signals applied to the drive motor. Typical of such direct drive servovalves is that illustrated in U.S. Pat. No. 4,793,377 issued Dec. 27, 1988, to Larry E. Haynes et al. The invention described and claimed herein is an improvement over the direct drive servovalve disclosed in U.S. Pat. No. 4,793,377 and therefore the disclosure of U.S. Pat. No. 4,793,377 is incorporated herein by this reference.

Other prior art known to applicants are U.S. Pat. No. Re. 16,026; U.S. Pat. Nos. 343,416; 2,912,870; 4,081,172; 4,126,296; 4,339,737; 4,384,703; 4,480,813; 4,614,812; 4,813,455; as well as Autrian Patent No. 1922 issued Feb. 1, 1900, and Norwegian Patent 42,506 issued Feb. 22, 1926.

It is critical in direct drive servovalves that the rotational movement of the drive member of the drive motor be limited. Such limitation is necessary during energization of the motor to absorb the full stroke rotor inertia without part damage or deformation. In prior-art valves, it has been traditional to provide such limitation by pins or similar stops keyed to or inserted into the rotor casing to be engaged by a protrusion from the rotary drive member. Alternatively, such limitation has been provided by pins or similar members extending through or from the rotary to engage stop surfaces provided in retainer plates or the rotor or stator housings.

SUMMARY OF THE INVENTION

In accordance with the present invention, there is provided a direct drive servovalve which includes a valve spool reciprocally mounted within a bore in a valve housing along with motor means including a rotary drive member to engage the valve for movement within the bore to provide control over the flow of fluid through the valve. The rotary drive member carries a cam-shaped flat washer which has surfaces engaging stop means defined by the valve housing.

BRIEF DESCRIPTION OF THE DRAWINGS

FIG. 2 is a cross-sectional view taken about the lines 2—2 of FIG. 1;

FIG. 3 is a top elevational view of a cam-shaped flat washer used as part of the stop means of the present invention; and FIG. 4 is a fragmentary bottom elevational view taken about the line 4—4 of FIG. 1 showing the valve housing and the member of FIG. 3 in operational position.

DESCRIPTION OF THE ILLUSTRATIVE EMBODIMENT

Figure 1:
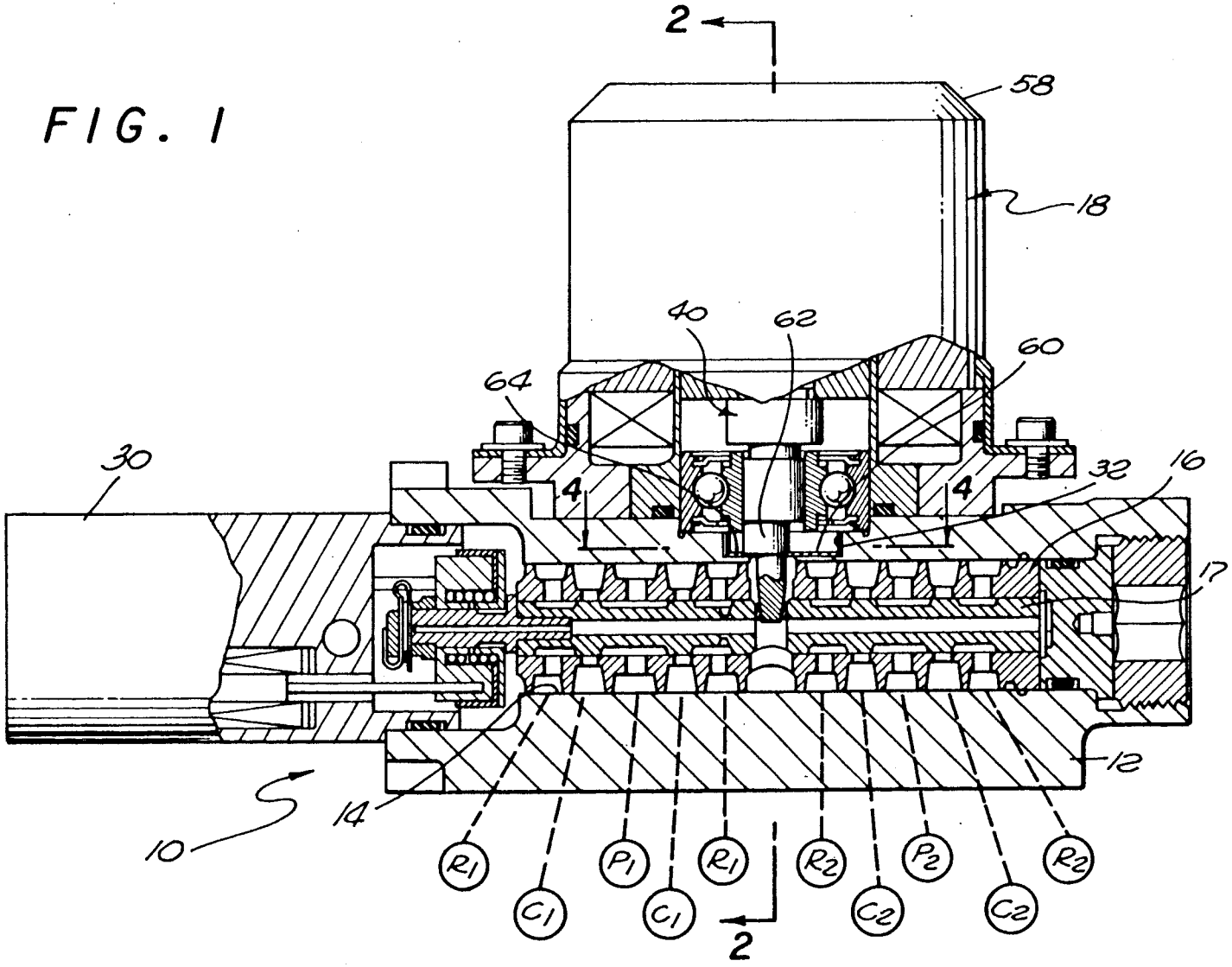
FIG. 1 is a longitudinal cross-sectional view of a direct drive servovalve constructed in accordance with the principles of the present invention.

By reference to FIG. 1, there is shown a direct drive valve 10 constructed in accordance with the principles of the present invention. As is therein shown, a valve housing 12 includes a first bore 14 within which there is positioned a sleeve 16. A reciprocally movable spool valve 17 is mounted within the sleeve 16. A servovalve torque motor 18 is affixed to the housing 12 by means of bolts or other fasteners 20 so that a rotary drive member 22 extends through a second bore 15 defined by the valve housing 12. The second bore is disposed transverse the first bore. The rotary drive member 22 engages an opening 24 provided therefor in the spool 17 to reciprocally move the spool 17 in response to electrical signals applied to the motor means 18 as is well known in the art.

As is illustrated in FIGS. 1 and 2, the motor means is a rotary motor including a stator 26 and a rotor 28 as is well known in the art.

As is shown particularly in FIG. 1, the direct drive servovalve constructed in accordance with the principles of the present invention includes appropriate ports for the control of fluid from dual sources thereof under pressure P1 and P2 to, for example, a dual tandem actuator (not shown) and from the actuator to return through the utilization of dual cylinder ports. Such is indicated by the designations P1, R1 and C1 as well as P2, R2 and C2. The valve assembly 10 may also include an LVDT 30 as is well known in the prior art. The construction of the rotary direct drive servovalve as illustrated in FIGS. 1 and 2 and thus far described is well known in the prior art and additional detail with regard thereto is not believed to be necessary.

As is shown more particularly in FIG. 2, the valve housing 12 defines a first recess 32 which receives the outer surface 34 of a bearing means 36 mounted upon one end 38 of the rotor shaft 40 of the motor means 18. The recess 32 conforms to the outer surface 34 cross-sectional configuration of the bearing 36 and has a depth which is substantially less than the longitudinal length of the outer surface 34 of the bearing 36. As a result and as is clearly illustrated in FIGS. 1 and 2, when the bearing is received within the recess 32, a substantial portion of the outer surface 34 thereof protrudes from the housing 12.

As a result of the longitudinal dimension of the outer surface 34 of the bearing 36, it can be seen from FIGS. 1 and 2 that the bearing is mutually received within a second recess 42 defined by the lower portion 44 of the isolation tube 46. The isolation tube 46 surrounds the rotor 28 of the motor means 18 and isolates hydraulic fluid from the stator portion 26 of the motor means 18.

The isolation tube 46 also includes an upper portion 48 thereof which defines a third recess 50 which receives a second bearing means 52. The bearing means 36 and 52 are utilized to support the rotor shaft 40 in a properly aligned position within the isolation tube 46. Such alignment is obtained by inserting the end 54 of the shaft 40 by way of an interference fit into the inner race of the bearing means 52. The outer race of the bearing means 52 is then inserted by means of a locational slip fit between the third recess 50 and the outer race of the bearing means 52. The bearing means 36 is then inserted by means of an interference fit between the outer surface 34 of the bearing means 36 and the second recess 42 inner surface as provided in the lower portion 44 of the isolation tube 46. A locational slip fit is provided between the lower portion 38 of the shaft 40 and the inner race of the bearing means 36.

A flat washer-like member 60 is thereafter placed upon the upper portion 62 of the rotary drive member 22 where it is received in a substantially non-slip relationship with respect to the shaft 40. A floor 64 of the recess 32 retains the washer 60 in place upon the shaft 40 after the drive member 22 has been inserted through the opening 15 in the floor 64 into engagement with the spool valve 17. A cover 58 is positioned over the assembly and secured in place by appropriate fasteners 20 as is well known to those skilled in the art.

By reference now more specifically to FIGS. 3 and 4, a more detailed and better understanding of the positive radial limit stop mechanism of the present invention will be obtained. As is shown particularly in FIG. 3, the flat washer-like member 60 defines an opening 66 therethrough. A plurality of inwardly directed tangs 68, 70 and 72 provide at least three contact areas 74, 76 and 78, respectively, for engagement with the upper portion 62 of the drive member 22. The flat washer-like member 60 includes an arm 80 extending outwardly therefrom and defining first and second surfaces 82 and 84, respectively.

The washer 60 fits upon the rotary drive member 22 and particularly the upper portion 62 thereof. As is particularly shown in FIG. 4, the upper portion 62 of the drive member 22 includes a surface 86 which is in the form of a second planar surface. The contact area 78 of the washer 60 defines a first planar surface 78. When the washer 60 is fitted upon the upper portion 62 of the rotary drive member 22, the first and second planar surfaces engage each other. The additional contact areas 74 and 76 of the washer 60 along with the planar surface 78 provide a locational slip fit between the contact areas 74, 76 and 78 and the surfaces of the upper portion 62 of the drive member 22. As a result, there is provided a substantially non-slip relationship between the washer-like member 60 and the drive member 62.

A pair of opposed walls 88 and 90 extend upwardly from the floor 64 thereby effectively defining a recess 92 within which the cam washer 60 resides when the direct drive servovalve is fully assembled. It will be apparent to those skilled in the art that as the rotary motor 18 is energized by the application of electrical signals thereto, the drive member rotates accordingly as is illustrated by the arrow 94. When the drive member rotates in a clockwise direction as viewed in FIG. 4, the surface 82 thereof will engage the wall 90 thus providing a positive radial limit stop in the clockwise direction of rotation irrespective of energization of the motor 18. Alternatively, if the motor 18 is energized to rotate the drive member 62 in the counterclockwise direction as viewed in FIG. 4, the surface 84 of the cam washer 60 will engage the wall 88 thereby providing a positive radial limit stop in the counterclockwise direction of rotation irrespective of energization of the motor 18.

What is claimed is:

1. A direct drive servovalve comprising:

(1) a valve housing defining first and second bores therein, said second bore disposed transverse said first bore;

(2) a valve spool reciprocally received within said first bore for movement to control fluid flow therethrough from a supply port;

(3) motor means including a rotary drive member extending through said second bore for engagement with said valve spool at a predetermined point to move said valve spool in said bore; and (4) means for limiting rotation of said rotary drive member comprising:

(a) a flat washer-like member carried by said rotary drive member and including an outwardly extending arm defining first and second surfaces;

(b) first and second opposed walls disposed within said second bore;

(c) said washer-like member being disposed within said second bore and positioned to permit said first and second surfaces thereof to contact said first and second walls respectively to thereby limit the radial movement of said rotary drive member.

2. A direct drive servovalve as defined in claim 1 wherein said washer-like member defines an opening therethrough for receiving said rotary drive member in a substantially non-slip relationship.

3. A direct drive servovalve as defined in claim 2 wherein said opening defines at least three distinct contact areas for engagement with said rotary drive member, at least one of said contact areas defines a first planar surface, said rotary drive member defining a second planar surface, said first and second planar surfaces being in engagement with each other.

4. A direct drive servovalve as defined in claim 3 which first includes a floor through which said second bore extends and from which said opposed walls rise, said floor retaining said washer on said rotary drive member.

5. A direct drive servovalve as defined in claim 4 wherein said washer member is received on said rotary drive member by a locational slip fit.

6. A direct drive servovalve as defined in claim 3 wherein each of said three distinct contact areas is defined by a radially inwardly extending tang.

* * * * *